US010297228B2

(12) United States Patent
Lee et al.

(10) Patent No.: US 10,297,228 B2
(45) Date of Patent: May 21, 2019

(54) DISPLAY APPARATUS AND CONTROL METHOD THEREOF

(71) Applicant: SAMSUNG ELECTRONICS CO., LTD., Suwon-si (KR)

(72) Inventors: Min-hoon Lee, Seoul (KR); Sang-hyoun Kim, Seoul (KR); Sung-jin Lim, Suwon-si (KR); Kyu-chan Lee, Yongin-si (KR); Jae-moon Lee, Yongin-si (KR); Hyoung-pyo Lee, Yongin-si (KR); Byung-kwan Kim, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/492,601

(22) Filed: Apr. 20, 2017

(65) Prior Publication Data

US 2018/0018938 A1 Jan. 18, 2018

(30) Foreign Application Priority Data

Jul. 18, 2016 (KR) ..... 10-2016-0090697

(51) Int. Cl.
*G09G 5/06* (2006.01)
*G09G 3/20* (2006.01)

(52) U.S. Cl.
CPC ..... *G09G 5/06* (2013.01); *G09G 3/20* (2013.01); *G09G 3/2074* (2013.01); *G09G 2300/0452* (2013.01); *G09G 2320/028* (2013.01); *G09G 2320/0276* (2013.01); *G09G 2320/0285* (2013.01); *G09G 2320/0626* (2013.01);

(Continued)

(58) Field of Classification Search
CPC ..... G09G 5/06; G09G 3/2074; G09G 2320/0626; G09G 2320/0673; G09G 2320/0276; H04N 5/202; H04N 9/69
See application file for complete search history.

(56) References Cited

U.S. PATENT DOCUMENTS

2003/0146893 A1 8/2003 Sawabe
2004/0135755 A1 7/2004 Hong
(Continued)

FOREIGN PATENT DOCUMENTS

JP 3999081 B2 10/2007
JP 4511375 B2 7/2010
(Continued)

OTHER PUBLICATIONS

Communication dated Nov. 13, 2017, issued by the European Patent Office in counterpart European Application No. 17167695.0.
(Continued)

*Primary Examiner* — Antonio A Caschera
(74) *Attorney, Agent, or Firm* — Sughrue Mion, PLLC

(57) ABSTRACT

A display apparatus includes: a display panel including a plurality of pixels; a storage configured to store a plurality of lookup tables respectively corresponding to a plurality of gamma values; and a processor configured to determine a lookup table, from among the plurality of lookup tables, to be applied to each of the plurality of pixels based on a location of each of the plurality of pixels on the display panel, and determine a brightness value of each of the plurality of pixels using the determined lookup table.

20 Claims, 14 Drawing Sheets

(52) U.S. Cl.
CPC ..... *G09G 2320/0666* (2013.01); *G09G 2320/0673* (2013.01); *G09G 2320/0686* (2013.01); *G09G 2360/16* (2013.01)

(56) References Cited

U.S. PATENT DOCUMENTS

| | | | | |
|---|---|---|---|---|
| 2005/0103976 | A1* | 5/2005 | Ioka | G09G 5/06 250/208.1 |
| 2006/0164329 | A1 | 7/2006 | Inoue et al. | |
| 2007/0252801 | A1 | 11/2007 | Park et al. | |
| 2009/0278866 | A1* | 11/2009 | Kim | G09G 3/20 345/690 |
| 2010/0007639 | A1 | 1/2010 | Jeong et al. | |
| 2010/0026731 | A1 | 2/2010 | Konuma | |
| 2010/0085361 | A1* | 4/2010 | Kim | G06T 5/008 345/428 |
| 2012/0200552 | A1 | 8/2012 | Jung et al. | |
| 2014/0247289 | A1 | 9/2014 | Park et al. | |
| 2015/0187303 | A1 | 7/2015 | Choi et al. | |

FOREIGN PATENT DOCUMENTS

| | | | |
|---|---|---|---|
| JP | 2015222328 | A | 12/2015 |
| KR | 100149296 | B1 | 12/1998 |
| KR | 2003-0067949 | A | 8/2003 |
| KR | 100462017 | B1 | 6/2005 |
| KR | 100914201 | B1 | 8/2009 |
| KR | 1020120090371 | A | 8/2012 |
| KR | 101183354 | B1 | 9/2012 |

OTHER PUBLICATIONS

Communication dated Jul. 21, 2017 by the European Patent Office in counterpart European Patent Application No. 17167695.0.
Communication dated Jul. 20, 2018, issued by the European Patent Office in counterpart European Application No. 17167695.0.

* cited by examiner

DISPLAY APPARATUS AND CONTROL METHOD THEREOF

CROSS-REFERENCE TO RELATED APPLICATION

This application claims priority from Korean Patent Application No. 10-2016-0090697, filed on Jul. 18, 2016 in the Korean Intellectual Property Office, the disclosure of which is incorporated herein by reference in its entirety.

BACKGROUND

Field

Apparatuses and methods consistent with exemplary embodiments relate to a display apparatus and a control method thereof, and more particularly, to a display apparatus which can enhance a viewing angle.

Related Art

Liquid crystal display (LCD) panels are widely used in display apparatuses. One desirable quality of a display apparatus is a wide viewing angle.

However, operational characteristics of the LCD panel may limit the viewing angle. For example, high grayscale values may provide a good viewing angle characteristic, but as the grayscale decreases, the viewing angle may become worse and discoloration may occur.

To solve this problem, a related-art method that divides a sub pixel into a low grayscale representation area and a high grayscale representation area has been proposed. However, the related-art method requires a separate circuit for dividing a pixel and additionally requires a backlight unit (BLU) due to a decreased aperture ratio. In addition, because the related-art method drives divided cells separately, the number of required integrated circuits (ICs) is doubled. Accordingly, the size of a timing controller (TCON) must be increased. Thus, the related-art method increases the cost of manufacturing display apparatuses.

SUMMARY

One or more exemplary embodiments may overcome the above disadvantages and other disadvantages not described above. However, it is understood that one or more exemplary embodiment are not required to overcome the disadvantages described above, and may not overcome any of the problems described above.

One or more exemplary embodiments provide a display apparatus which can enhance a viewing angle by storing a plurality of lookup tables corresponding to a plurality of gamma values, and applying appropriate lookup tables according to locations of RGB sub pixels, and a control method thereof.

According to an aspect of an exemplary embodiment, there is provided a display apparatus including: a display panel including a plurality of pixels; a storage configured to store a plurality of lookup tables respectively corresponding to a plurality of gamma values; and a processor configured to determine a lookup table, from among the plurality of lookup tables, to be applied to each of the plurality of pixels based on a location of each of the plurality of pixels on the display panel, and determine a brightness value of each of the plurality of pixels using the determined lookup table.

The processor may be further configured to generate a new lookup table by crossing values of the plurality of lookup tables, and to store the new lookup table in the storage.

The processor may be further configured to generate a plurality of sub lookup tables by dividing each of the plurality of lookup tables, and to store the plurality of sub lookup tables in the storage.

The processor may be further configured to cross-map the brightness values determined for the plurality of pixels using the plurality of lookup tables every time a frame is changed.

The processor may be further configured to cross-map through a frame in which a brightness value generated based on a reference gamma value or the inputted pixel value is mapped in response to a difference between pixel values input to neighbor pixels being greater than or equal to a predetermined value.

The processor may be further configured to determine whether to apply the brightness value generated based on the reference gamma value or the inputted pixel value based on the inputted pixel values of neighbor pixels of the plurality of pixels, and determine a lookup table, from among the plurality of lookup tables, to be applied to each of the plurality of pixels based on the location of each of the plurality of pixels on the display panel in response to determining to not apply the brightness value generated based on the reference gamma value or the inputted pixel value.

The processor may be further configured to determine a lookup table, from among the plurality of lookup tables, to be applied to each of the plurality of pixels based on the location of each of the plurality of pixels on the display panel in response to a difference between a pixel value of each of the plurality of pixels and an input pixel value of a neighbor pixel being less than a predetermined value.

The processor may be further configured to apply, to each of the plurality of pixels, a corresponding brightness value which is interpolated by giving a weight value to a brightness value which is determined using the plurality of lookup tables based on inputted pixel values of neighbor pixels of the plurality of pixels, and a brightness value generated based on a reference gamma value or the inputted pixel value.

The processor may be further configured to determine brightness values of the plurality of pixels where an on-screen display (OSD) is displayed based on a brightness value generated based on a reference gamma value or an inputted pixel value in response to receiving an input signal for displaying the OSD.

The processor may be further configured to determine whether to apply a brightness value generated based on a reference gamma value or an inputted pixel value based on a type of an input image.

The processor may be further configured to determine a lookup table from among the plurality of lookup tables to be applied to each of the plurality of pixels included in a single pixel line of the display panel, and apply other lookup tables except for the determined lookup table to a next pixel line adjacent the single pixel line.

The display apparatus may further include a panel driver configured to drive the display panel, the processor may be further configured to determine a lookup table, from among the plurality of lookup tables, to be applied in response to a binary signal of the panel driver regarding each of the plurality of pixels.

According to an aspect of another exemplary embodiment, there is provided a control method of a display apparatus, the control method including: storing a plurality of lookup tables respectively corresponding to a plurality of gamma values; determining a lookup table, from among the plurality of stored lookup tables, to be applied to each of the plurality of pixels based on a location of each of the plurality of pixels on a display panel of the display apparatus; and determining a brightness value of each of the plurality of pixels using the determined lookup table.

The control method may further include cross-mapping the brightness values determined for the plurality of pixels using the plurality of lookup tables every time a frame is changed.

The cross-mapping may include cross-mapping through a frame in which a brightness value generated based on a reference gamma value or the inputted pixel value is mapped in response to a difference between pixel values inputted to neighbor pixels being greater than or equal to a predetermined value.

The control method may further include determining whether to apply the brightness value generated based on the reference gamma value or the inputted pixel value based on the inputted pixel values of neighbor pixels of the plurality of pixels, and the determining the lookup table may include determining a lookup table, from among the plurality of lookup tables, to be applied to each of the plurality of pixels based on the location of each of the plurality of pixels on the display panel in response determining the brightness value generated based on the reference gamma value or the inputted pixel value is not applied.

The determining may include determining not to apply the brightness value generated based on the reference gamma value or the inputted pixel value in response to a difference between a pixel value of each of the plurality of pixels and an inputted pixel value of a neighbor pixel being less than a predetermined value.

The control method may further include interpolating, for each of the plurality of pixels, by giving a weight value to a brightness value which is determined using the plurality of lookup tables based on inputted pixel values of neighbor pixels of the plurality of pixels, and to a brightness value generated based on a reference gamma value or to the inputted pixel value; and applying the interpolated brightness values to each of the plurality of pixels, respectively.

The determining the lookup table may include determining, in response to an input signal for displaying an on-screen display (OSD) on some of the plurality of pixels, brightness values of the plurality of pixels where the OSD is displayed based on a brightness value generated based on a reference gamma value or an inputted pixel value.

The control method may further include determining whether to apply a brightness value generated based on a reference gamma value or an inputted pixel value based on a type of an input image.

BRIEF DESCRIPTION OF THE DRAWINGS

The above and/or other aspects will be more apparent from the following description of exemplary embodiments, with reference to the accompanying drawings, in which.

DETAILED DESCRIPTION OF EXEMPLARY EMBODIMENTS

Exemplary embodiments will be described herein below with reference to the accompanying drawings. In the following description, well-known functions or constructions are not described in detail for conciseness The term including an ordinal number such as "first" and "second" may be used to explain various elements, but the elements are not limited by these terms. These terms may be used for the purpose of distinguishing one element from another element. For example, a first element may be named a second element without departing from the scope of right of the present disclosure, and similarly, a second element may be named a first element. The term "and/or" includes a combination of a plurality of relevant items, or one of the plurality of relevant items.

The terms used in the present disclosure are for describing particular exemplary embodiments and are not intended to limit the present disclosure. As used herein, the singular forms are intended to include the plural forms as well, unless the context clearly indicates otherwise. The terms "comprise," "include" or "have" used in the exemplary embodiments of the present disclosure indicate the presence of corresponding features, numbers, operations, elements, parts, or a combination of these, and do not preclude the presence or addition of one or more other features, numbers, operations, elements, parts, or a combination of these.

Figure 1:
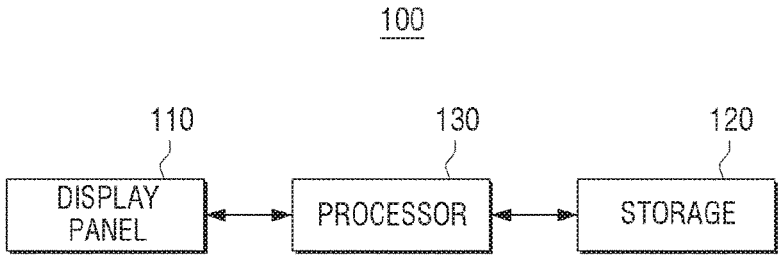
FIG. 1 is a schematic block diagram of a display apparatus according to an exemplary embodiment.

FIG. 1 is a schematic block diagram of a display apparatus 100 according to an exemplary embodiment. The display apparatus 100 may be implemented by using all kinds of electronic devices including a display panel, such as a television (TV), a monitor, a notebook personal computer (PC), a tablet, a kiosk, or the like. Referring to FIG. 1, the display apparatus 100 may include a display panel 110, a storage 120, and a processor 130.

The display panel 110 may include a plurality of pixels. For example, the pixel may include sub pixels indicating red (R), green (G), and blue (B), collectively referred to as RGB. In another example, the pixel may include sub pixel indicating white (W) in addition to the RGB sub pixels.

The display panel 110 may include a plurality of gate lines and a plurality of data lines. The gate line is a line for transmitting a scan signal or a gate signal, and the data line is a line for transmitting a data voltage. For example, each of the plurality of pixels may be connected with a single gate line and a single data line.

The above-described connection method may be called a 1D1G structure. The display apparatus 100 according to an exemplary embodiment has advantages over the related-art methods in that it does not divide the pixels and thus is not required to change to a 2D1G structure in which each of the plurality of pixels is connected with a single gate line and two data lines.

The storage 120 may store a lookup table. The storage 120 may store a plurality of lookup tables which are generated with a plurality of gamma values. In addition, the storage 120 may store a lookup table which is generated with a reference gamma value.

The processor 130 may compose each of the plurality of lookup tables by crossing values of two or more lookup tables according to a viewing angle enhancement level or compensation level. For example, the processor 130 may compose a new lookup table by using values derived from a first lookup table generated with a first gamma value with respect to a low grayscale portion, and using values derived from a second lookup table generated with a second gamma value with respect to a high grayscale portion. It is easy to distinguish brightness on a low grayscale area using a lookup table having low gamma values, and it is easy to distinguish brightness on a high grayscale area using a lookup table having high gamma values. Therefore, the storage 120 may store new lookup tables which are generated by crossing the values of the first lookup table and the second lookup table.

In addition, the processor 130 may generate a plurality of sub lookup tables by dividing each of the plurality of lookup tables. In addition, the processor 130 may control the storage 120 to store the plurality of generated sub lookup tables. For example, the processor 130 may divide at least one of the plurality of lookup tables into two or more sub lookup tables. The processor 130 may enhance a viewing angle and compensate for a gamma error using three or four lookup tables generated in the above-described way. When the plurality of lookup tables are divided into two or more lookup tables, the processor 130 may cross-map a plurality of brightness values.

In addition, the storage 120 may store at least one lookup table which is generated with values between the first gamma value and the second gamma value.

For example, the lookup table may store an output brightness value corresponding to an inputted grayscale value. In addition, a relationship between the grayscale value and the brightness value may be determined based on a function of a gamma value.

For example, the reference gamma value may be 2.2 which is a standard gamma value of the National Television System Committee (NTSC). In another example, the reference gamma value may be 2.8 which is a standard gamma value of Phase Alternation by Line (PAL).

The processor 130 may determine a lookup table to be applied to each of the plurality of pixels based on a location of each of the plurality of pixels on the display panel 110.

The processor 130 may determine a lookup table to be applied to each of the plurality of pixels from among the plurality of lookup tables stored in the storage 120, such that an image displayed on the display apparatus has a characteristic which is same with reference gamma when viewed from the front, and has a visual advantage when viewed from the side.

For example, on a specific location of the display panel 110, a representation regarding a low grayscale area should be enhanced in order to achieve an effect of enhancing the viewing angle. In this case, the processor 30 may apply a lookup table which is appropriate to represent a low grayscale and a lookup table for compensating for a gamma after enhancing the viewing angle to the pixels existing in the corresponding location.

In addition, the processor 130 may determine a brightness value of each of the plurality of pixels using the determined lookup table. The processor 130 may apply a different lookup table to each of the plurality of pixels, and may apply a different lookup table to each of the plurality of sub pixels. A detailed operation of the processor 130 will be described below.

As described above, the display apparatus 100 may apply accurate color control (ACC) of the low grayscale and the high grayscale according to locations of the R, G and B sub pixels without changing the structure of the display panel.

Figure 2:
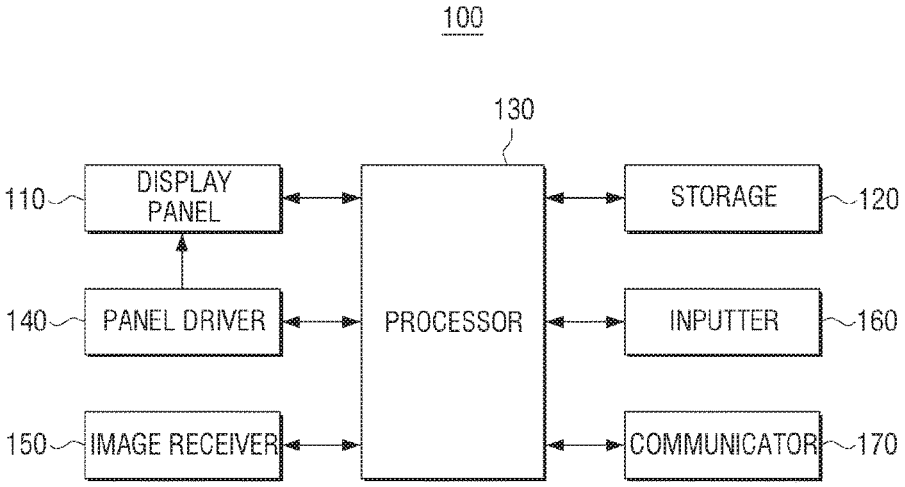
FIG. 2 is a block diagram of a display apparatus in detail according to an exemplary embodiment.

FIG. 2 is a block diagram to illustrate a configuration of a display apparatus 100 in detail according to an exemplary embodiment. Referring to FIG. 2, the display apparatus 100 may include a display panel 110, a storage 120, a processor 130, a panel driver 140, an image receiver 150, an inputter 160, and a communicator 170. However, the display apparatus 100 does not necessarily include all of the above-described elements as in the exemplary embodiment of FIG. 2. In addition, the display apparatus 100 may additionally include elements such as an audio outputter (not shown), a power supply (not shown), or the like, which are not illustrated.

The display panel 110 may include a liquid crystal layer, a pixel electrode, a liquid crystal capacitor, a gate line, a data line, a backlight unit, or the like. The display panel 110 may represent brightness of each pixel according to a brightness value which is determined through the lookup table.

The storage 120 may store various programs for driving the display apparatus 100 and data. The storage 120 may be implemented in the form of a flash memory, a hard disk, or the like. For example, the storage 120 may include a read only memory (ROM) for storing programs for performing the operation of the display apparatus 100, and a random access memory (RAM) for temporarily storing data which is generated by performing the operation of the display apparatus 100. In addition, the storage 120 may further include an electrically erasable and programmable ROM (EEPROM) for storing a variety of reference data.

The lookup table may be stored in the storage 120 in the display apparatus 100, or a lookup table stored in an external server may be used. In this case, the communicator 170 may communicate with the external server to receive the lookup table.

The panel driver 140 may provide a driving signal to the display panel 110. For example, the panel driver 140 may include a gate driver (not shown), a data driver (not shown), a grayscale voltage generator (not shown), and a signal controller (not shown). In the exemplary embodiment of FIG. 2, the panel driver 140 is described as a separate element, but, according to another exemplary embodiment, the processor 130 may perform the role of the panel driver 140.

The image receiver 150 receives image content data via various sources. For example, the image receiver 150 may receive broadcast data from an external broadcasting station. In addition, the image receiver 150 may receive image data from an external device (for example, a DVD player, a PC), or may stream image data from an external server.

The inputter 160 may receive a request, a command, or data for controlling the operation of the display apparatus 100 from a user. For example, the inputter 160 may be implemented by using a keypad, a mouse, a touch panel, a touch screen, a track ball, a jog switch, a motion recognizer, a voice recognizer, or the like.

The communicator 170 may communicate with (transmit data to and/or receive data from) an internal element or an external device. For example, the communicator 170 may receive image data, a lookup table, or the like.

The communicator 170 may use various methods such as a high definition multimedia interface (HDMI), low voltage differential signaling (LVDS), a local area network (LAN), a universal serial bus (USB), Inter-Integrated Circuit (I2C), Parallel, or the like. However, the present disclosure is not limited to the above-described communication methods, and for example, the communicator 170 may communicate with an external server in a wireless communication method.

The processor 130 may control the overall operation of the display apparatus 100. The processor 130 may be implemented by using a single central processing unit (CPU) and may perform all operations of processing an image, determining a lookup table to be applied, and controlling the other elements. Alternatively, the processor 130 may be implemented by using a plurality of processors such as a CPU, a GPU, an image signal processor (ISP), or the like and an IP for performing a specific function.

According to an exemplary embodiment, the processor 130 may determine a lookup table to be applied to each of the plurality of pixels based on a location of each of the plurality of pixels on the display panel. The processor 130 may determine the lookup table to be applied on a sub pixel basis or a pixel line basis rather than on a pixel basis. In the drawings, for convenience of explanation, a lookup table generated based on the first gamma value is marked with 'A,' a lookup table generated based on the second gamma value is marked with 'B,' and a lookup table generated based on the reference gamma value is marked with 'N.' In addition, other letters 'C,' 'D,' or the like are illustrated to explain a case in which at least one of the plurality of lookup tables for enhancing the viewing angle and compensating for a gamma error is divided into a plurality of sub lookup tables.

Figure 3:
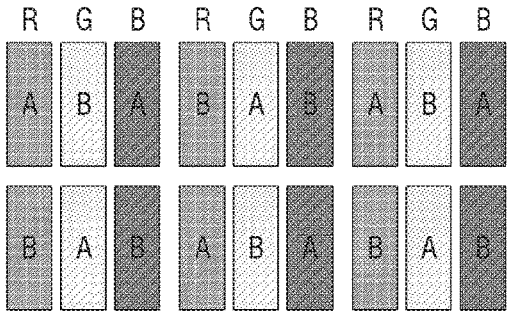
FIGS. 3, 4 and 5 are views to illustrate mapping lookup tables according to various exemplary embodiments.
Figure 4:
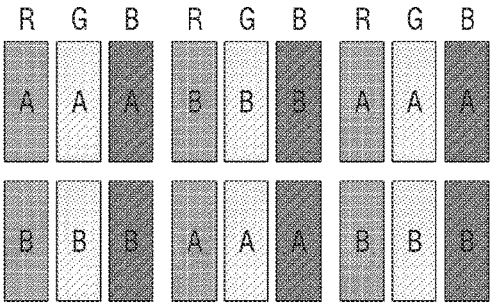
Figure 5:
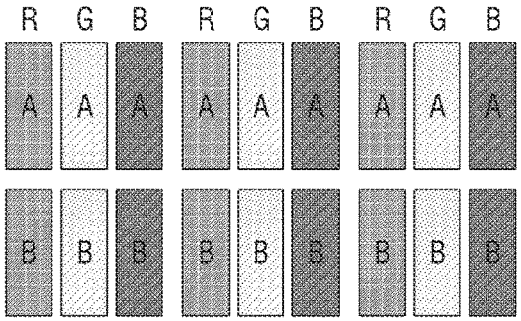

Referring to FIG. 3, the processor 130 may determine a lookup table to be applied on a sub pixel basis indicating each of RGB sub pixel. In FIG. 3, each rectangle indicates a sub pixel. In an exemplary embodiment in which RGBW are used in addition to RGB, the processor 130 may determine a lookup table to be applied on a sub pixel basis indicating each of RGBW. Referring to FIG. 4, the processor 130 may determine a lookup table to be applied on a pixel basis. In another example, the processor 130 may determine a lookup table to be applied on a pixel line basis as shown in FIG. 5.

The processor 130 may determine a lookup table to be applied on the sub pixel basis, the pixel basis, or the pixel line basis as described above, and also, may determine a lookup table on the sub pixel basis on some areas, and determine a lookup table on the pixel line basis on the other areas.

According to an exemplary embodiment, the processor 130 may determine a lookup table to be applied to each of the plurality of sub pixels included in a single pixel line of the display panel 110. In addition, with respect to the next pixel line, the processor 130 may reverse the lookup tables to be applied to the determined single pixel line and apply the lookup tables. For example, on the assumption that a single pixel line is formed of nine sub pixels, the processor 130 may determine lookup tables to be applied to the first pixel line as 'ABBAABABA.' In addition, with respect to the second pixel line, the processor 130 may determine lookup tables to be applied to the sub pixels as 'BAABBABAB' by reversing the mapping of the lookup tables determined for the first pixel line.

In the above-described example, the reversing is performed on a single pixel line basis. However, the processor 130 may reverse the mapping of the lookup tables on a two-pixel-line basis and apply the lookup tables.

As described above, the lookup tables to be applied are determined according to the characteristic and structure of the display panel 110, such that the display apparatus 100 according to an exemplary embodiment can enhance the viewing angle using the grayscale without changing the structure of the display panel 110. In addition, the display apparatus 100 can maintain original brightness when the user views the display panel 110 in front of the display apparatus 100, and also, can enhance the viewing angle when the user views the display panel 110 from the side.

According to an exemplary embodiment, the processor 130 may determine a lookup table to be applied according to a location of a sub pixel or a pixel. Alternatively, the processor 130 may determine a lookup table to be applied in response to a reversing/non-reversing signal of the panel driver 140. The display apparatus 100 may have polarities of pixels set differently because problems such as an image crosstalk, a flicker, a load balance, an increase in power consumption, or the like may arise. For example, it is advantageous to reverse polarities of all neighbor pixels to be different from one another to prevent the crosstalk. The processor 130 may determine the lookup table to be applied to each of the pixels from among the plurality of lookup tables in response to a reversing/non-reversing signal for controlling the polarity of the pixel.

To the contrary, the processor 130 may control the panel driver 140 to generate a reversing/non-reversing signal based on selection information of the lookup table determined for each pixel.

Figure 6:
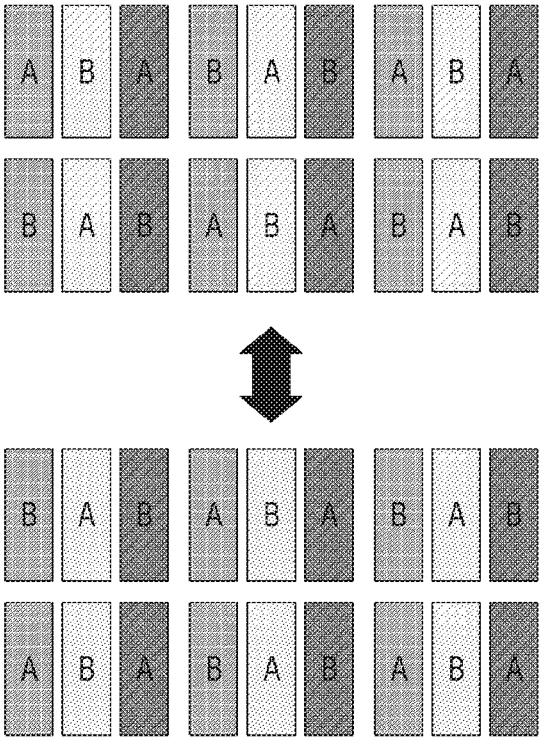
FIG. 6 is a view to illustrate reversing mapping of lookup tables when a frame is changed.

According to an exemplary embodiment, the processor 130 may reverse the mapping of the determined lookup tables every time a frame of an image is changed. Referring to FIG. 6, in response to a first frame (upper view of FIG. 6) being displayed, the processor 130 may determine which of the first lookup table (A) and the second lookup table (B) will be applied on the sub pixel basis.

In addition, in response to the next frame, the second frame (lower view of FIG. 6), being displayed, the processor 130 may reverse the mapping of the lookup tables determined for the first frame, and apply the lookup tables. For example, with respect to a sub pixel the output brightness value of which is determined according to the first lookup table (A) in the first frame, the processor 130 may determine an output brightness value according to the second lookup table (B) in the second frame. By doing so, the processor 130 can maintain original brightness when an image is viewed from the front, and also, can enhance the viewing angle when an image is viewed from the side.

Figure 7:
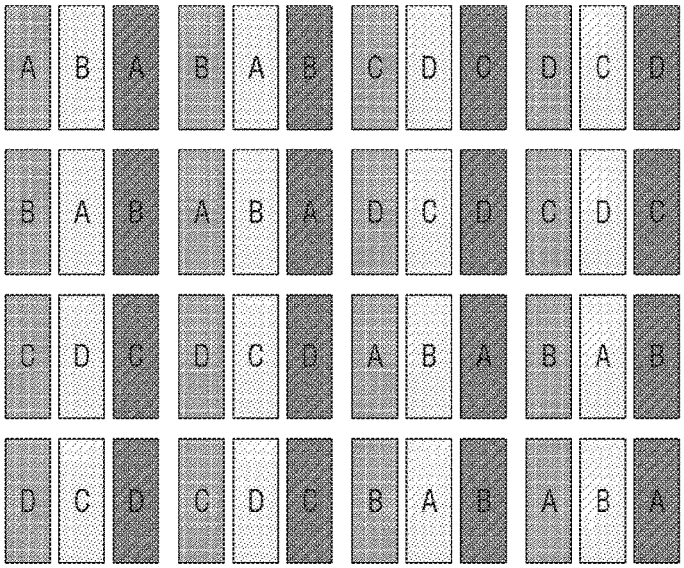
FIGS. 7 and 8 are views to illustrate mapping a plurality of lookup tables according to various exemplary embodiments.
Figure 8:
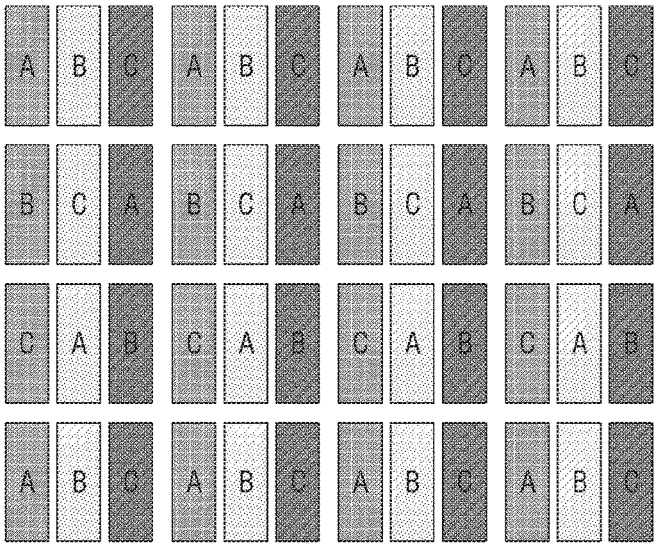

FIGS. 7 and 8 are views illustrating an exemplary embodiment in which pixels are mapped using two or more lookup tables.

Referring to FIG. 7, the processor 130 may determine a lookup table to be applied on the sub pixel basis indicating RGB using four lookup tables. For example, the processor 130 may generate four sub lookup tables by dividing each of the first lookup table generated based on the first gamma value and the second lookup table generated based on the second gamma value, which is different from the first gamma value, into two sub lookup tables. In FIG. 7, sub pixels mapped with the four sub lookup tables are illustrated as 'A,' 'B,' 'C,' and 'D.' The locations matched with the lookup tables are selectable and variable. Like in the case in which two lookup tables are used, the processor 130 may determine whether a brightness value generated based on a reference gamma value or an inputted pixel value is used by comparing a difference in pixel values inputted to neighbor pixels, and may determine whether the four sub lookup tables generated from the first and second lookup tables are used or not.

Referring to FIG. 8, the processor 130 may determine a lookup table to be applied on the sub pixel basis using three lookup tables. For example, the processor 130 may divide one of the plurality of lookup tables (for example, the first and second lookup tables) into two sub lookup tables, such that three lookup tables are used. The processor 130 may determine which lookup table will be mapped based on the location of each sub pixel on the display panel 110.

When the display panel 110 is implemented by using an LCD, the processor 130 should control to rotate liquid crystals in order to change brightness. However, when a difference in the brightness values is great, the radius of rotation of the liquid crystals is great. Therefore, the rotation speed of the liquid crystals may not keep pace with a frame change speed according to the response speed of the display panel 110.

Figure 9:
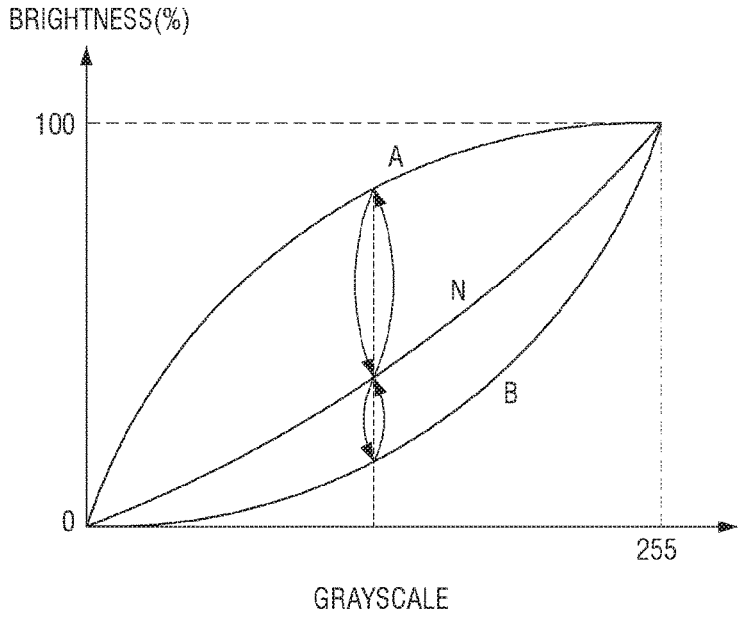
FIGS. 9 and 10 are views to illustrate a method for enhancing a response speed of a display apparatus according to an exemplary embodiment.

According to an exemplary embodiment, in response to a difference between the brightness values determined based on the first lookup table (A) and the second lookup table (B) being greater than or equal to a predetermined value, the processor 130 may include a frame which is mapped with the brightness value generated based on the reference gamma value or the inputted pixel value, and control the brightness value to be changed in each frame. That is, as shown in FIG. 9, lookup tables which have been applied in order of A→B→A may be applied in order of A→N→B→N→A every time the frame is changed.

Figure 10:
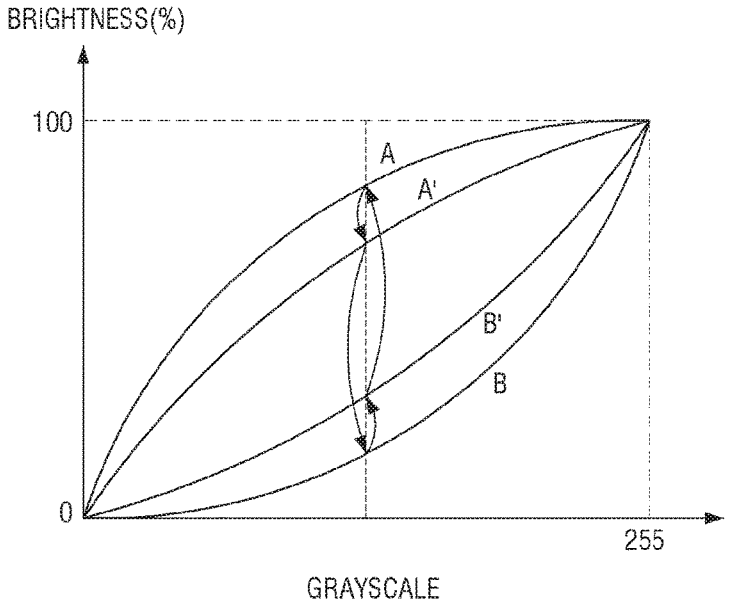

According to another exemplary embodiment, the processor 130 may use a lookup table (A') which is generated based on a gamma value between the first gamma value for generating the first lookup table (A) and the reference gamma value, and a lookup table (B') which is generated based on a gamma value between the second gamma value for generating the second lookup table (B) and the reference gamma value. As shown in FIG. 10, the processor 130 may change the lookup tables to be applied in order of A→A'→B→B'→A every time the frame is changed.

According to an exemplary embodiment, as shown in FIG. 7, the processor 130 may generate the first lookup table (A) based on the first gamma value which is higher than the reference gamma value, and generate the second lookup table (B) based on the second gamma value which is lower than the reference gamma value.

However, the first lookup table for enhancing the viewing angle is not necessarily generated based on the gamma value higher than the reference gamma value.

Figure 11:
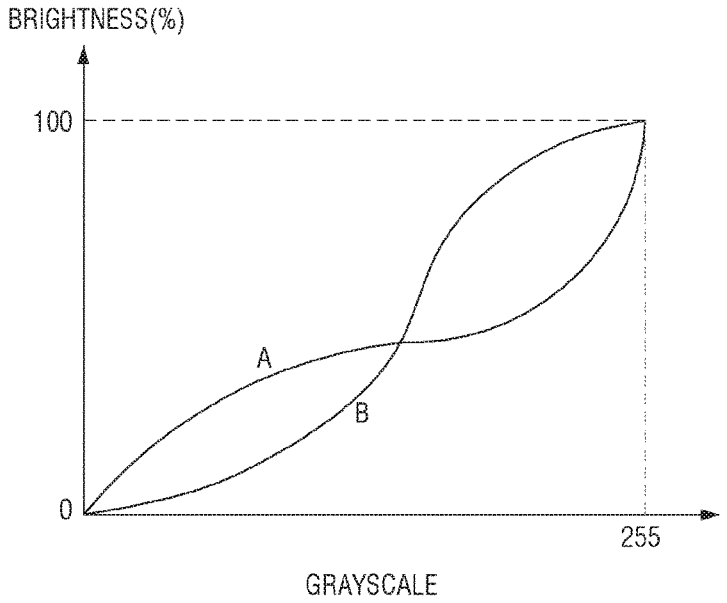
FIG. 11 is a view to illustrate a lookup table configuration according to another exemplary embodiment.

According to another exemplary embodiment, as shown in FIG. 11, the processor 130 may generate the first lookup table (A) for enhancing the viewing angle based on a gamma value which is higher than the reference gamma value in a low grayscale section, and may generate the first lookup table (A) based on a gamma value which is lower than the reference gamma value in a high grayscale section.

Likewise, the processor 130 may generate the second lookup table (B) for compensating for the gamma error based on a gamma value which is lower than the reference gamma value in the low grayscale section, and generate the second lookup table (B) based on a gamma value which is higher than the reference gamma value in the high grayscale section. There is no problem as long as an average of brightness in the first lookup table and the second lookup table corresponds to brightness using the reference gamma value with reference to a specific grayscale value. The same effect is applied when a plurality of lookup tables are used. Accordingly, the display apparatus 100 can maintain brightness using the reference gamma value on the front, and also, can enhance the viewing angle on the side.

In a specific case, using a lookup table (N) generated based on the reference gamma value instead of using the plurality of lookup tables (A/B) for enhancing the viewing angle may be appropriate to user's viewing. The processor 130 may determine which of the lookup table (N) generated based on the reference gamma value and the plurality of lookup tables (A/B) for enhancing the viewing angle will be used first.

According to an exemplary embodiment, the processor 130 may determine whether the lookup table (N) generated based on the brightness value determined as the reference gamma value or the inputted pixel value is used, or whether the lookup table (A/B) appropriate to the low grayscale or high grayscale area is used, based on pixel values inputted to neighbor pixels of the plurality of pixels.

Figure 12:
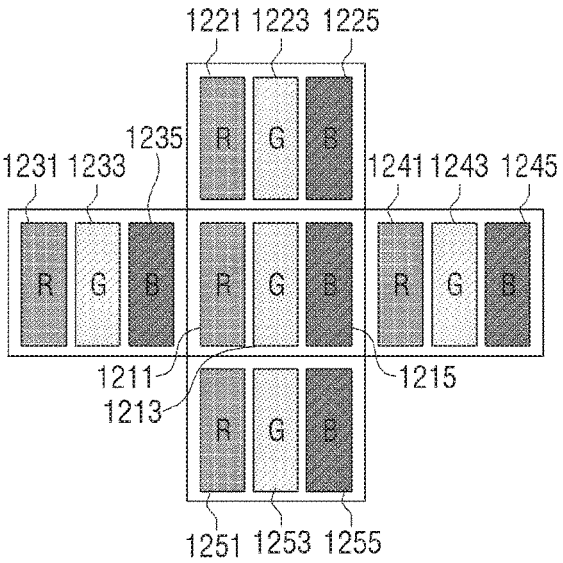
FIG. 12 is a view to illustrate selecting a lookup table according to a difference in an input value between neighbor pixels.

FIG. 12 illustrates sub pixels 1211, 1213, 1215, 1221, 1223, 1225, 1231, 1233, 1235, 1241, 1243, 1245, 1251, 1253 and 1255. The processor 130 may determine which lookup table will be applied to a sub pixel 1211 by comparing neighbor sub pixels 1221, 1231, 1241, and 1251 representing the same color. For example, the processor 130 may compare a grayscale value inputted to the sub pixel 1211 and grayscale values inputted to the neighbor sub pixels 1221, 1231, 1241, and 1251. In response to a difference between the grayscale values being less than a predetermined value, the processor 130 may use the lookup table (A/B) for enhancing the viewing angle.

To the contrary, in response to the difference being greater than or equal to the predetermined value, the processor 130 may use the lookup table (N) which is formed of the brightness value generated based on the reference gamma value, or the inputted pixel value. When there is an edge in an image, the difference between the input pixel values of the neighbor pixels may be greater than or equal to the predetermined value.

According to an exemplary embodiment, the processor 130 may apply, to each of the plurality of pixels, a brightness value which is obtained by interpolating a brightness value which is determined using the lookup table (N), which is formed of the brightness value generated based on the reference gamma value or the inputted pixel value, based on the pixel values inputted to neighbor pixels of the plurality of pixels, and a brightness value which is determined using the lookup table (A/B) for enhancing the viewing angle.

For example, the processor 130 may compare the grayscale value inputted to the sub pixel 1211 and the grayscale values inputted to the neighbor sub pixels 1221, 1231, 1241, and 1251. In addition, the processor 130 may obtain an interpolated brightness value by applying a weight value to the brightness value which is determined using the lookup table (N), which is formed of the brightness value generated based on the reference gamma value or the inputted pixel value, and to the brightness value which is determined using the lookup table (A/B) for enhancing the viewing angle, according to a difference between the grayscale values.

In response to the difference in the input values being great, the processor 130 may apply a greater weight value to the lookup table (N) formed of the brightness value generated based on the reference gamma value or the inputted pixel value, and, in response to the difference in the input values being small, may apply a greater weight value to the lookup table (A/B) for enhancing the viewing angle.

According to an exemplary embodiment, the processor 130 may designate some areas of the display panel 110, and may determine brightness values of the plurality of pixels included in the designated areas using the lookup table (N) which is formed of the brightness value generated based on the reference gamma value or the inputted pixel value.

Figure 13:
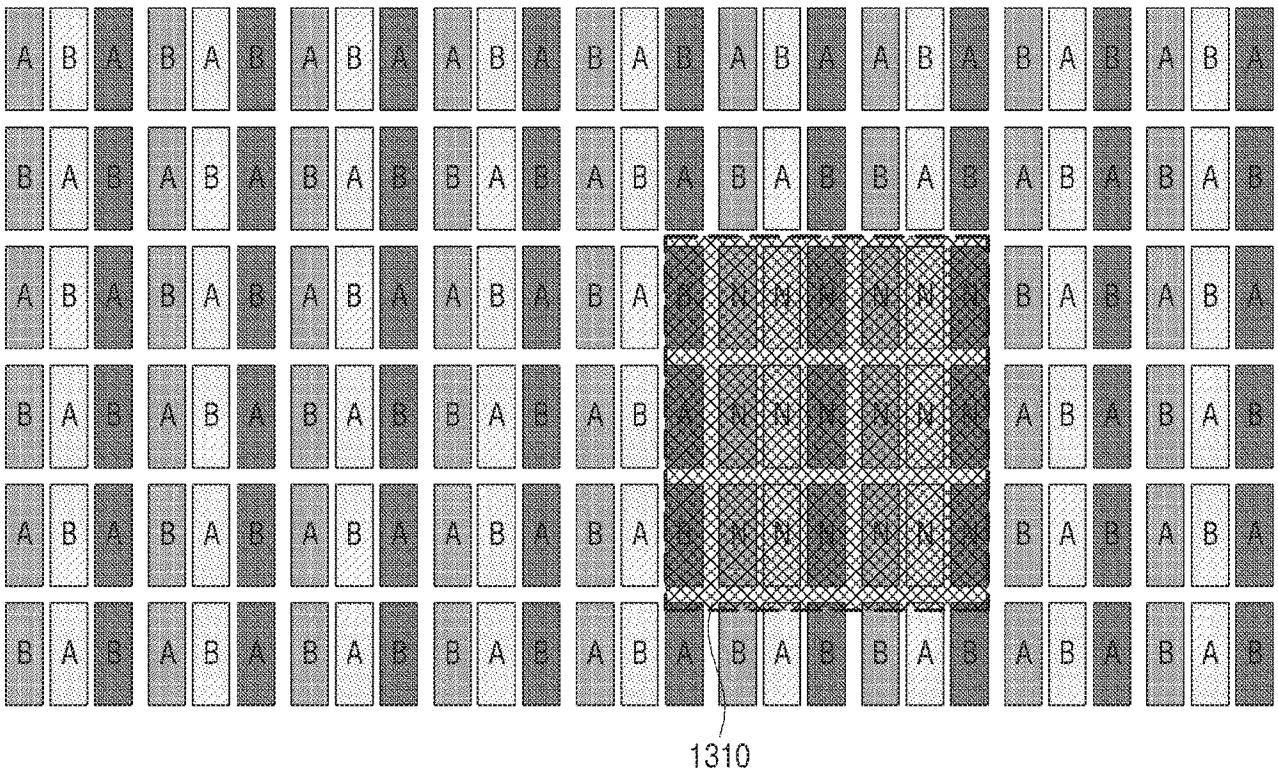
FIG. 13 is a view to illustrate an example of an OSD being displayed on some pixels.

For example, in response to an input signal for displaying an on screen display (OSD) on some of the plurality of pixels, the processor 130 may determine brightness values of the pixels where the OSD is displayed using the lookup table (N) which is formed of the brightness value generated based on the reference gamma value or the inputted pixel value. Referring to FIG. 13, with respect to an area 1310 where the OSD is to be displayed, the processor 130 may determine brightness values of the pixels included in the corresponding area 1310 using the lookup table (N) which is formed of the brightness value generated based on the reference gamma value or the inputted pixel value, instead of using the lookup table (A/B) for enhancing the viewing angle. The processor 130 may control the display panel 110 to display the OSD to display a UI menu, a guide message, an alarming message, or the like for receiving a user input.

According to an exemplary embodiment, the processor 130 may determine which lookup table will be used out of the lookup table (N) formed of the brightness value generated based on the reference gamma value or the inputted pixel value, and the lookup table (A/B) for enhancing the viewing angle, based on a type of an input image. For example, in the case of a PC input, an image is required to be outputted as it is without enhancing a viewing angle. Accordingly, the processor 130 may determine a type of an input image and select a lookup table to be used according to the determined type of the input image.

According to another exemplary embodiment, the processor 130 may not apply the lookup table (A/B) for enhancing the viewing angle to pixels of an external area close to a bezel. For example, the processor 130 may determine brightness values of pixels located at the outermost area using the lookup table (N) which is formed of the brightness value generated based on the reference gamma value or the inputted pixel value. When the lookup table for enhancing the viewing angle is used for the external area close to the bezel, a distortion may occur in the image.

According to various exemplary embodiments as described above, the display apparatus can enhance the viewing angle which is limited according to the grayscale without changing the structure of the display panel. In addition, the display apparatus of the present disclosure does not additionally require a data line, a driving IC, or the like and thus can prevent a manufacturing cost from increasing.

In addition, the viewing angle can be enhanced regardless of the structure of the display panel. Therefore, there is an advantage that display panels manufactured by different manufacturers or having different structures can be used.

Figure 14:
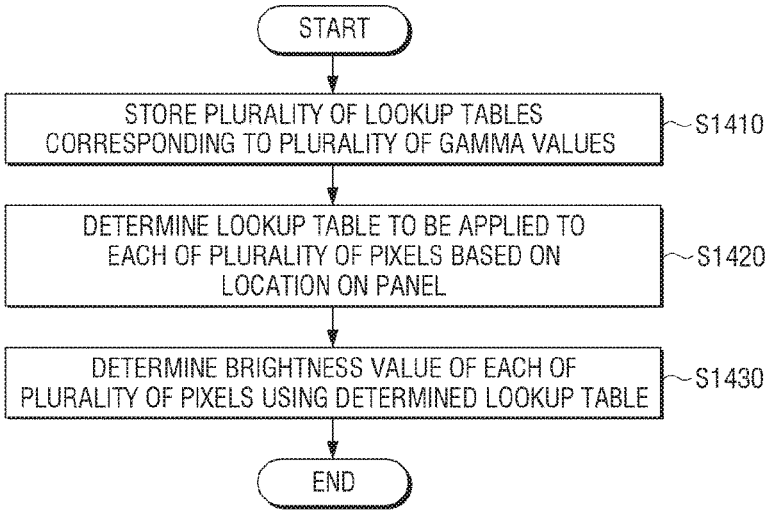
FIG. 14 is a flowchart to illustrate a control method of a display apparatus according to an exemplary embodiment.

FIG. 14 is a flowchart to illustrate a control method of the display apparatus 100 according to an exemplary embodiment. Referring to FIG. 14, the display apparatus 100 may store a plurality of lookup tables corresponding to a plurality of gamma values (S1410). For example, the display apparatus 100 may generate a first lookup table based on a first gamma value, and generate a second lookup table based on a second gamma value which is different from the first gamma value. In addition, the display apparatus 100 may further store a lookup table which is generated based on a reference gamma value.

In addition, the display apparatus 100 may generate a new lookup table by crossing the values of the plurality of lookup tables and store the new lookup table. In addition, the display apparatus 100 may generate a plurality of sub lookup tables by dividing each of the plurality of lookup tables.

The display apparatus 100 may determine a lookup table to be applied to each of the plurality of pixels from among the plurality of stored lookup tables, based on a location of each of the plurality of pixels on a display panel (S1420). In another example, the display apparatus 100 may determine a lookup table to be applied on a sub pixel basis.

In addition, the display apparatus 100 may determine a brightness value of each of the plurality of pixels using the determined lookup table (1430).

Various exemplary embodiments of the control method correspond to the exemplary embodiments of the display apparatus 100 and thus a detailed description thereof is omitted and a redundant explanation is prevented.

The methods described above may be implemented in the form of a program commands which are performed via various computer means and may be recorded on a computer readable medium. The computer-readable medium may include program commands, data files, and data structures either alone or in combination. The program commands recorded on the medium may be those that are especially designed and configured for the present disclosure, or may be those that are publicly known and available to those skilled in the art. Examples of the computer-readable recording medium include magnetic recording media such as hard disks, floppy disks and magnetic tapes, optical recording media such as CD-ROMs and DVDs, magneto-optical recording media such as floptical disks, and hardware devices such as ROMs, RAMs and flash memories that are especially configured to store and execute program commands. Examples of the program commands include machine language codes created by a compiler, and high-level language codes that can be executed by a computer by using an interpreter. The hardware device described above may be configured to operate as one or more software modules to perform the operations of the exemplary embodiments, and the same is true in reverse.

While exemplary embodiments have been shown and described with reference to certain exemplary embodiments thereof, it will be understood by those skilled in the art that various changes in form and details may be made therein without departing from the spirit and scope as defined by the appended claims. Therefore, the scope is defined not by the detailed description, but by the appended claims, and all differences within the scope will be construed as being included in the present disclosure.

What is claimed is:

1. A display apparatus comprising:

a display panel comprising a plurality of sub pixels;

a storage configured to store a plurality of lookup tables respectively corresponding to a plurality of gamma values; and a processor configured to:

determine a first lookup table and a second lookup table, from among the plurality of lookup tables, for each of the plurality of sub pixels based on a location of each of the plurality of sub pixels on the display panel, determine a first brightness value for a first sub pixel of the plurality of sub pixels using the first lookup table, determine a second brightness value for the first sub pixel using the second lookup table, control the display panel to drive the first sub pixel based on the first brightness value in a first frame, and control the display panel to drive the first sub pixel based on the second brightness value in a second frame.

2. The display apparatus of claim 1, wherein the processor is further configured to generate a new lookup table by crossing values of the plurality of lookup tables, and to store the new lookup table in the storage.

3. The display apparatus of claim 1, wherein the processor is further configured to generate a plurality of sub lookup tables by dividing each of the plurality of lookup tables, and to store the plurality of sub lookup tables in the storage.

4. The display apparatus of claim 1, wherein the processor is further configured to cross-map brightness values determined for the plurality of sub pixels using the plurality of lookup tables every time a frame is changed.

5. The display apparatus of claim 4, wherein, the processor is further configured to, in response to a difference between sub pixel values input to neighbor sub pixels being greater than or equal to a predetermined value, cross-map through a frame in which a brightness value generated based on a reference gamma value or an inputted sub pixel value is mapped.

6. The display apparatus of claim 1, wherein the processor is further configured to determine whether to apply a reference brightness value generated based on a reference gamma value or an inputted sub pixel value based on inputted sub pixel values of neighbor sub pixels of the plurality of sub pixels, and, in response to determining to not apply the reference brightness value generated based on the reference gamma value or the inputted sub pixel value, to determine the first lookup table and the second lookup table, from among the plurality of lookup tables, to be alternately applied to each of the plurality of sub pixels based on the location of each of the plurality of sub pixels on the display panel.

7. The display apparatus of claim 6, wherein the processor is further configured to, in response to a difference between a sub pixel value of each of the plurality of sub pixels and an input sub pixel value of a neighbor sub pixel being less than a predetermined value, determine the first lookup table and the second lookup table from among the plurality of lookup tables to be alternately applied to each of the plurality of sub pixels based on the location of each of the plurality of sub pixels on the display panel.

8. The display apparatus of claim 1, wherein the processor is further configured to apply, to each of the plurality of sub pixels, a corresponding brightness value which is interpolated by giving a weight value to a brightness value which is determined using the plurality of lookup tables based on inputted sub pixel values of neighbor sub pixels of the plurality of sub pixels, and a reference brightness value generated based on a reference gamma value or an inputted sub pixel value.

9. The display apparatus of claim 1, wherein, the processor is further configured to, in response to receiving an input signal for displaying an on-screen display (OSD) on some of the plurality of sub pixels, determine brightness values of the plurality of sub pixels where the OSD is displayed, based on a reference gamma value or an inputted sub pixel value.

10. The display apparatus of claim 1, wherein the processor is further configured to determine whether to apply a brightness value generated based on a reference gamma value or an inputted sub pixel value based on a type of an input image.

11. The display apparatus of claim 1, further comprising a panel driver configured to drive the display panel, wherein the processor is further configured to determine a lookup table, from among the plurality of lookup tables, to be applied in response to a binary signal of the panel driver regarding each of the plurality of sub pixels.

12. A display apparatus comprising:

a display panel comprising a plurality of sub pixels;

a storage configured to store a plurality of lookup tables respectively corresponding to a plurality of gamma values; and a processor configured to determine a first lookup table and a second lookup table, from among the plurality of lookup tables for each of the plurality of sub pixels based on a location of each of the plurality of sub pixels on the display panel, sequentially determine a brightness value of each of the plurality of sub pixels alternately using the first lookup table and the second lookup table, and control the display panel to drive the plurality of sub pixels respectively based on the brightness value determined for each of the plurality of sub pixels, wherein the processor is further configured to determine the first lookup table and the second lookup table, from among the plurality of lookup tables, to be alternately applied to each of the plurality of sub pixels included in a single pixel line of the display panel, and inversely apply the second lookup table and the first lookup table to a next pixel line adjacent the single pixel line.

13. A control method of a display apparatus, the control method comprising:

storing a plurality of lookup tables respectively corresponding to a plurality of gamma values;

determining a first lookup table and a second lookup table, from among the plurality of stored lookup tables for each of a plurality of sub pixels based on a location of each of the plurality of sub pixels on a display panel of the display apparatus;

determining a first brightness value for a first sub pixel of the plurality of sub pixels using the first lookup table;

determining a second brightness value for the first sub pixel using the second lookup table;

controlling the display panel to drive the first sub pixel based on the first brightness value in a first frame; and controlling the display panel to drive the first sub pixel based on the second brightness value in a second frame.

14. The control method of claim 13, further comprising cross-mapping brightness values determined for the plurality of sub pixels using the plurality of lookup tables every time a frame is changed.

15. The control method of claim 14, wherein the cross-mapping comprises, in response to a difference between sub pixel values inputted to neighbor sub pixels being greater than or equal to a predetermined value, cross-mapping through a frame in which a brightness value generated based on a reference gamma value or inputted sub pixel value is mapped.

16. The control method of claim 13, further comprising determining whether to apply a brightness value generated based on a reference gamma value or an inputted sub pixel value based on inputted sub pixel values of neighbor sub pixels of the plurality of sub pixels, wherein the determining the first lookup table and the second lookup table comprises, in response to determining the brightness value generated based on the reference gamma value or the inputted sub pixel value is not applied, determining the first lookup table and the second lookup table, from among the plurality of lookup tables, to be applied to each of the plurality of sub pixels based on the location of each of the plurality of sub pixels on the display panel.

17. The control method of claim 16, wherein the determining comprises, in response to a difference between a sub pixel value of each of the plurality of sub pixels and the inputted sub pixel value of a neighbor sub pixel being less than a predetermined value, determining not to apply the brightness value generated based on the reference gamma value or the inputted sub pixel value.

18. The control method of claim 13, further comprising:

interpolating, for each of the plurality of sub pixels, by giving a weight value to a brightness value which is determined using the plurality of lookup tables based on inputted sub pixel values of neighbor sub pixels of the plurality of sub pixels, and to the brightness value generated based on a reference gamma value or to an inputted sub pixel value; and applying the interpolated brightness values to each of the plurality of sub pixels, respectively.

19. The control method of claim 13, wherein the determining the first lookup table and the second lookup table comprises, in response to an input signal for displaying an on-screen display (OSD) on some of the plurality of sub pixels, determining brightness values of the plurality of sub pixels where the OSD is displayed, based on a reference gamma value or an inputted sub pixel value.

20. The control method of claim 13, further comprising determining whether to apply a brightness value generated based on a reference gamma value or an inputted sub pixel value based on a type of an input image.

* * * * *